United States Patent [19]

Zaffrann et al.

[11] 4,395,606

[45] Jul. 26, 1983

[54] DISCONNECT SWITCH WITH LINE-SIDE CONTACT MODULE

[75] Inventors: Albert A. Zaffrann, Milwaukee; Robert E. Borchardt, Brown Deer; Grant W. Nelson, Milwaukee, all of Wis.

[73] Assignee: Allen-Bradley Company, Milwaukee, Wis.

[21] Appl. No.: 242,429

[22] Filed: Mar. 11, 1981

[51] Int. Cl.[3] ..... H01H 9/30; H01H 33/04

[52] U.S. Cl. ..... 200/144 R; 200/146 R; 200/293

[58] Field of Search ..... 200/144 R, 146 R, 147 R, 200/147 B, 148 C, 293, 304, 305, 306

[56] References Cited

U.S. PATENT DOCUMENTS

| | | | |
|---|---|---|---|
| 3,958,095 | 5/1976 | Zaffrann et al. | 200/144 R X |
| 4,011,425 | 3/1977 | Gryctko | 200/144 R |
| 4,251,700 | 2/1981 | Zaffrann et al. | 200/146 R |

*Primary Examiner*—J. R. Scott

*Attorney, Agent, or Firm*—Quarles & Brady

[57] ABSTRACT

A manually operable, three-pole disconnect switch has a contact structure for each pole that comprises a line-side contact module and a load-side contact module that carry the stationary contacts for that pole, these contacts being vertically spaced and positioned for engagement by one of three movable contact assemblies carried on a horizontally disposed, pivotable crossbar. Each line-side contact module extends upwardly from the crossbar and each load-side contact module extends downwardly from the crossbar and its corresponding line-side contact module. The line-side contact module has two integrally formed housing parts and a bar-shaped conductor that is sandwiched therebetween and positioned in a substantially vertical plane. The housing forms both an insulating base and an insulating portion of an arc chute which partially encloses the conductor that forms a stationary contact within a housing cavity. The line-side module is supported upon a pedestal of its corresponding load-side module, this pedestal having a slot which receives the stationary contact portion of the conductor to provide a tongue-in-groove coupling between the two modules.

4 Claims, 10 Drawing Figures

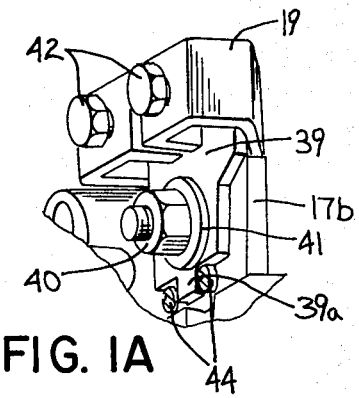
FIG. 1A
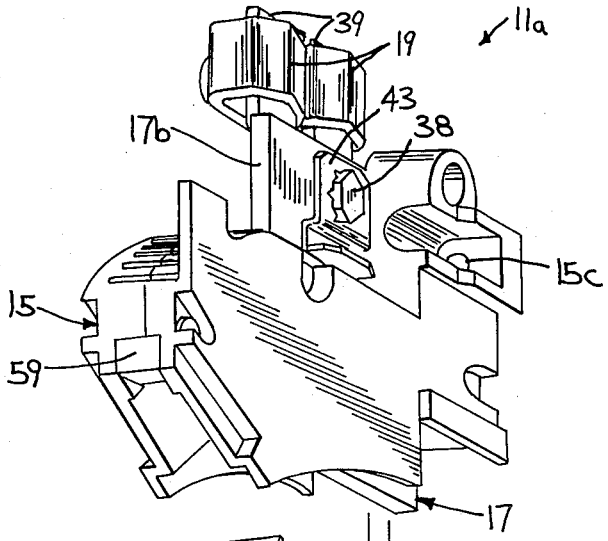
FIG. 1
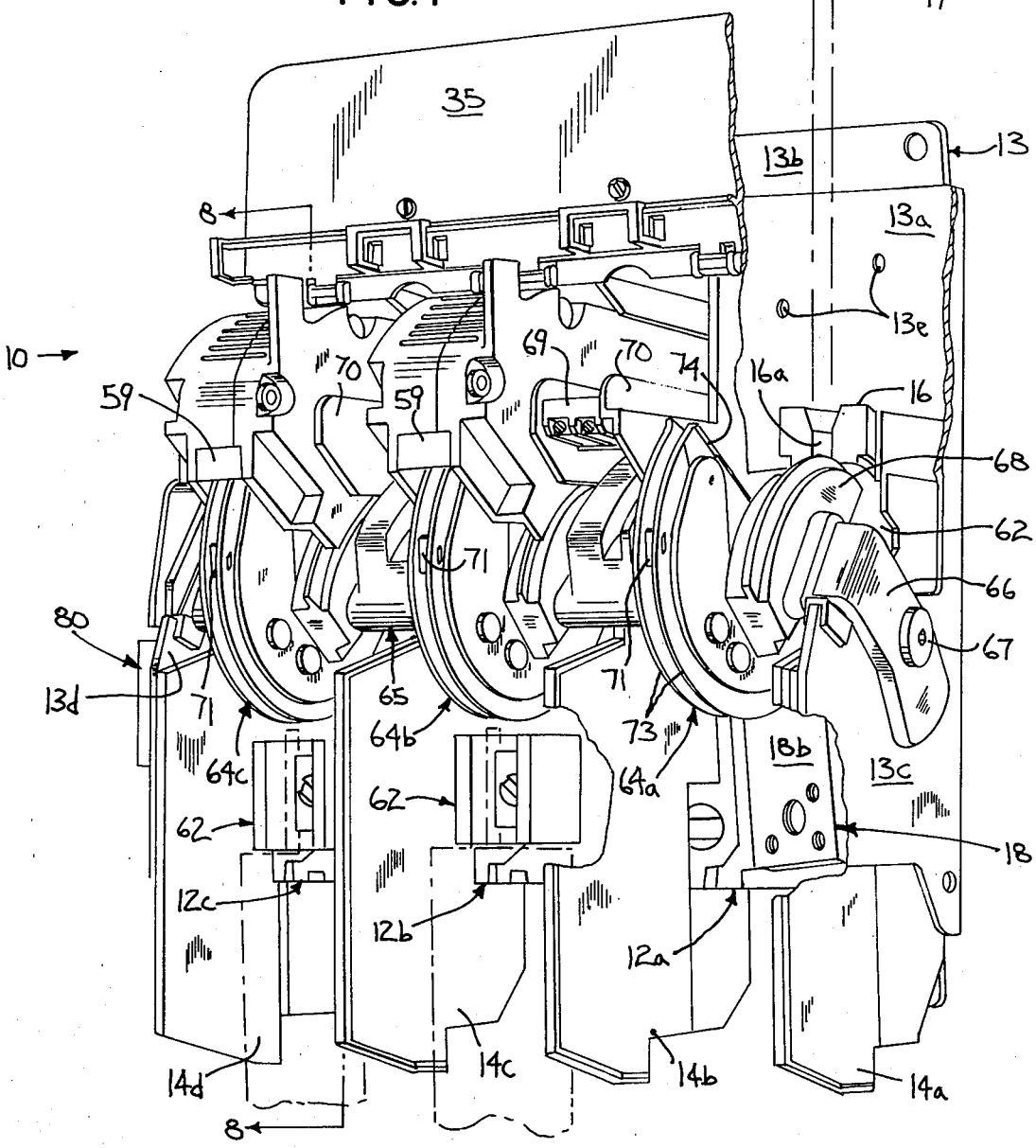

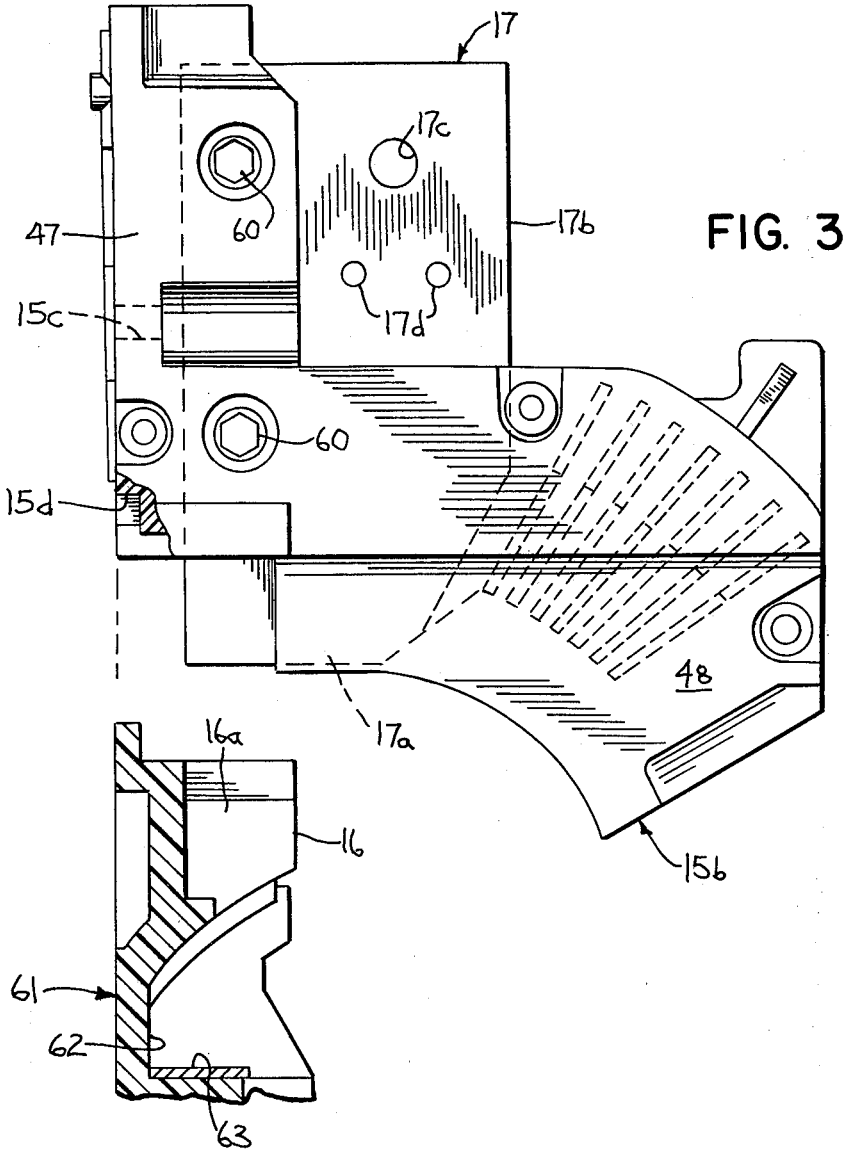
FIG. 3
FIG. 4
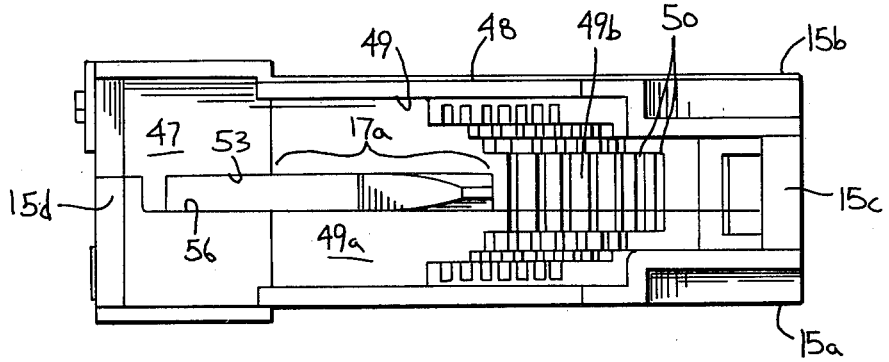

DISCONNECT SWITCH WITH LINE-SIDE CONTACT MODULE

BACKGROUND OF THE INVENTION

1. Field of the Invention

The field of the invention is disconnect switches and circuit breaker mechanisms used in industrial power distribution circuits.

2. Description of the Prior Art

Manually operated disconnect switches are used in plant distribution lines that feed industrial loads. Such switches are characterized by their ratings which typically range from 30 amperes to 400 amperes. Larger current carrying capacities require proportionally larger contacts and terminals, and greater spacing is required between such contacts or terminals and any other conducting portions of the switch supporting structure. On the other hand, appreciable amounts of heat are generated in the switch contacts and terminals and this heat must be dissipated at a reasonable rate. Thus, the construction of the insulating portions of the switch structure must provide electrical insulation without high heat retention.

Zaffrann, U.S. Pat. No. 4,251,700, issued Feb. 17, 1981, entitled "Disconnect Switch," and assigned to the assignee of the present invention, discloses a multi-pole manual disconnect switch rated at 200 amperes. Each pole has a load-side stationary contact that is continuously engaged by a pair of arcuate contact blades. The blades are carried by a crossbar, which when pivoted to its closed position carries the blades into contact with a line-side stationary contact. The load-side and line-side stationary contacts are spaced apart and are connected to respective terminals that are mounted on a base of insulating material.

This construction cannot be adapted to higher current ratings, such as 400 amperes, due to the increase in size required for the stationary contacts and terminals on the line-side and the heat retention that results from such contacts and terminals being mounted on the insulating base provided in the prior disconnect switch.

Besides these considerations, there is also a need to improve the manner of assembling the stationary contact module, which in the prior construction could not be conveniently removed without first removing the contact carrying crossbar.

SUMMARY OF THE INVENTION

The invention is incorporated in a disconnect switch in which a first stationary contact is mounted as part of a line-side module to a switch supporting structure, and in which a second stationary contact is mounted as part of a load-side module to the supporting structure, and in which movable contact means are positioned in engagement with the stationary contact of the load-side module and are operable for movement to engage the stationary contact of the line-side module to complete a circuit between the switch terminals.

The line-side contact module has a housing of insulating material that forms an elongated insulating base, which is mounted to an upper portion of the supporting structure above an elongated insulating base for the load-side contact module. This housing forms an arc chute hood that projects forward from the lower end of its insulating base and has a downwardly opening cavity. The line-side contact module is further provided with an elongated bar-shaped conductor positioned on its insulating base in a vertical plane that is substantially parallel to the plane of the load-side stationary contact. This conductor extends from within the arc chute cavity upwardly through the arc chute hood to provide both a stationary contact within the housing cavity and an exposed terminal portion, which extends above the arc chute hood and forward of its supporting base of insulating material.

By providing the conductor as described for the line-side contact module, sufficient spacing is maintained between the conductor and other conductive areas in the switch structure, while the exposed area of the conductor is increased for greater heat dissipation. The shape and the position of the conductor also contribute to the capability of forming a housing for the line-side contact module as two integrally formed counterparts that can be coupled together to sandwich the conductor therebetween. Each of these integrally formed sections provides a portion of the base and a portion of the arc chute hood. The hood portion of each section has slots disposed along angularly spaced radii to receive ears on deionization plates, which like the conductor, are sandwiched between the sections of the housing.

The line-side contact module and the load-side contact module have mating sections which separate at approximately the height of the crossbar in its closed position, which allows the line-side module to be easily removed from the back support and lifted over the crossbar.

The upper end of the load-side module is formed with a pedestal having a slot therein that receives a downwardly projecting portion of the conductor in the line-side contact module to provide a tongue-in-groove coupling between the two modules. The pedestal portion of the load-side module provides required insulation around a portion of the contact in the line-side module.

Other objects and advantages of the invention will appear from the following description, in which references made to the accompanying drawings, which form a part hereof, and in which there is shown by way of illustration a preferred embodiment of the invention. Such embodiment does not necessarily represent the full scope of the invention, however, in references thereto made to the claims herein for interpreting the scope of the invention.

BRIEF DESCRIPTION OF THE DRAWINGS

FIG. 1 is a perspective view of a multipole disconnect switch that embodies the invention, with an exploded perspective view of the line-side contact module and with a portion of rightmost barrier and sidewall broken away to illustrate the load-side contact module;

FIG. 1*a* is a detail view of the double lug mounted on the line-side contact module;

FIG. 3 is a left side view in elevation of the line-side contact module of FIG. 1 with the double lug removed and with an upper portion of the load-side contact module in section;

FIG. 4 is a bottom view of the line-side contact module of FIG. 3;

DETAILED DESCRIPTION OF THE PREFERRED EMBODIMENT

Referring to FIG. 1, a manually operable, three-pole disconnect switch 10 that incorporates the present invention is formed of contact modules 11*a*–11*c* and 12*a*–12*c* which are mounted to a back support portion 13*a* of a metal frame 13. The metal frame 13 includes apertured flanges 13*b* along its top and bottom edges to allow the switch 10 to be mounted to the back wall of an electrical equipment enclosure or other supporting structure. The mounting frame 13 also includes upright, horizontally spaced-apart sidewalls 13*c* and 13*d* which are integrally formed with the back support portion 13*a* and which extend forward to enclose the sides of the switch 10.

The area between the sidewalls 13*c* and 13*d* is divided into three vertical compartments by four horizontally spaced, vertical barriers 14*a*–14*d*. These barriers 14*a*–14*d* are molded from an electrically insulated thermoplastic polypropylene material. One barrier 14*a*, 14*d* is disposed face-to-face with the inside of each metal sidewall 13*c*, 13*d* to insulate such sidewall from conductive areas in the switch 10, and two of the barriers 14*b* and 14*c* separate the middle compartment from the two side compartments. The first vertical barrier 14*a* is mounted on the right side of the load-side contact module 12*a*, the next vertical barrier 14*b* is mounted on the load-side contact module 12*b* in the middle compartment and the remaining barriers 14*c* and 14*d* are mounted on the load-side contact module 12*c* in the left compartment.

Each pole of the three-pole switch 10 is formed in a respective compartment. As seen in FIG. 1, one of the line-side contact modules 11*a* has been removed from its position in the right compartment where it is bolted to the upper portion of the back support 13*a* into tapped holes 13*e* in the back support 13*a* through other holes 15*c* that are formed in a housing 15 for the line-side contact module 11*a* and seen best in FIG. 6. Referring again to FIG. 1, each compartment also holds a load-side contact module 12*a*–12*c*, which is mounted to a lower portion of the back support 13*a*, and which extends upwardly between its adjacent barriers 14*a*–14*d* to a slotted pedestal 16 which supports a corresponding line-side contact module 11*a*–11*c*.

Figure 2:
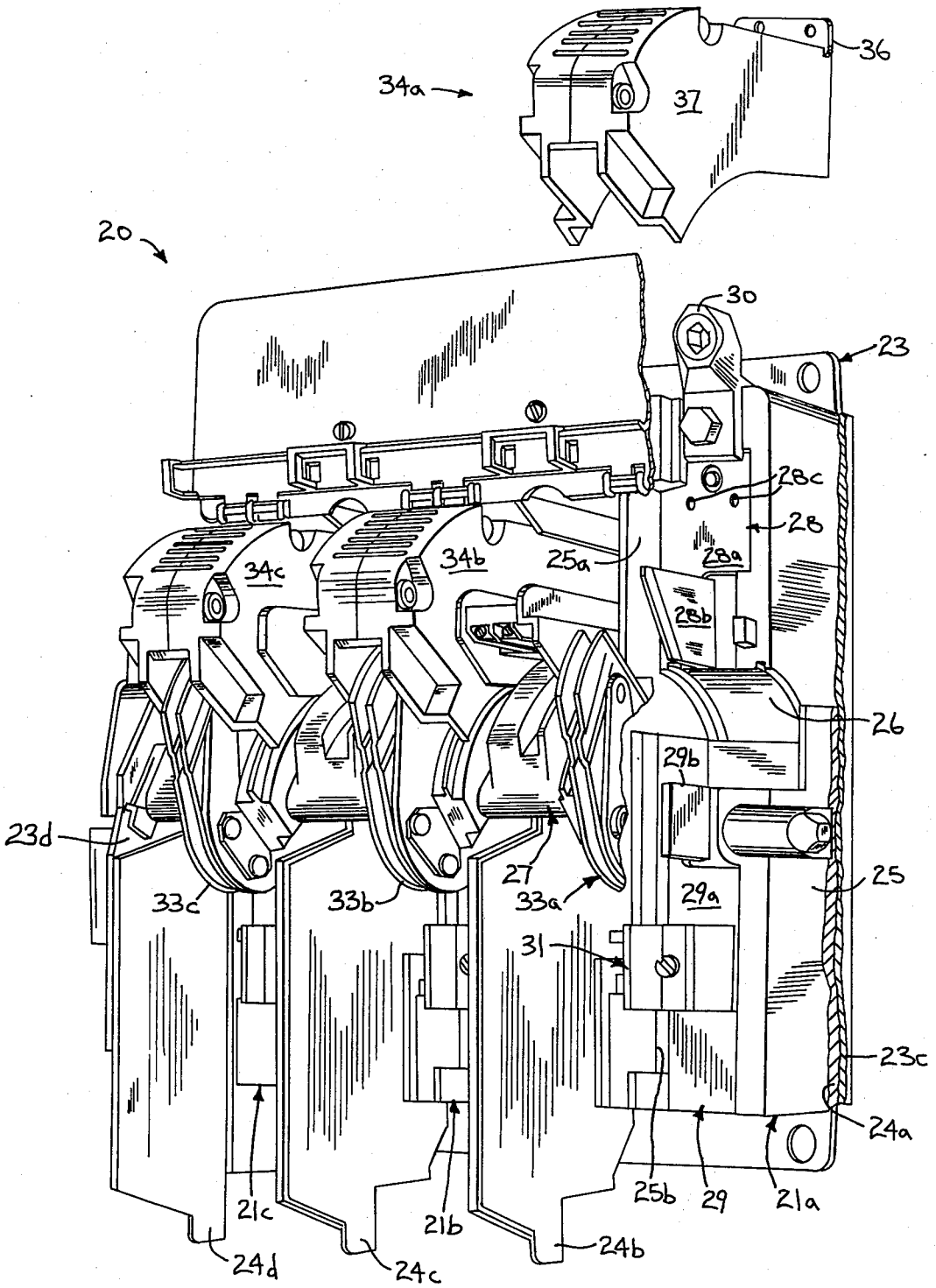
PRIOR ART FIG. 2
FIG. 2 is a perspective view of a disconnect switch of the prior art with parts exploded and parts broken away to better illustrate a contact module of the prior art.

The contact modules 11*a* and 12*a* of FIG. 1 are to be compared with the unitary contact modules 21*a*–21*c*, seen in FIG. 2 as part of a switch 20 of the prior art, which is disclosed in Zaffrann et al, U.S. Pat. No. 4,251,700, issued Feb. 17, 1981, and assigned to the assignee of the present invention. This switch 20 has a metal frame 23 with sidewalls 23*c* and 23*d*, and with vertical barriers 24*a*–24*d* being horizontally spaced apart to form three switch compartments, the right sidewall 23*c* and the right vertical barrier 24*a* being broken away for a better view of the contact module 21*a*.

This contact module 21*a* has a unitary base 25 molded of an electrically insulating thermoset phenolic material and this base 25 is bolted to the back support portion (not seen in FIG. 2) of the frame 23. The insulating base 25 has an upper portion and a lower portion divided by a crossbar-receiving cavity 26 formed midway between the top and bottom ends of the base 25. This cavity 26 receives a portion of a crossbar 27 when it carries movable contact assemblies 33*a*–33*c* into a closed position. The upper and lower portions of the insulating base 25 each have a channel 25*a*, 25*b* formed therein for receiving conductors 28 and 29, respectively. The first conductor 28 is disposed in the upper channel 25*a* and has a planar terminal portion 28*a* positioned approximately parallel to the back support portion (not shown) of the metal frame 23. At its lower end this conductor 28 forms a stationary contact 28*b* from a portion bent perpendicular to its terminal portion 28*a* and extending outwardly therefrom towards the front of the switch 20. A lug 30 is mounted to the upper end of this conductor 28 for connecting a line from a power source and therefore, this conductor 28 is referred to as a "line-side" conductor 28 and its stationary contact 28*b* is a "line-side" stationary contact.

Similarly, the conductor 29 is disposed in the lower channel 25*b* and has a stationary contact 29*b* formed at the upper end of its terminal portion 29*a*. A fuse clip 31 is mounted to the terminal portion 29*a* to hold one lead of a fuse (not shown) in a line going to a load. Therefore, this stationary contact 29*b* is referred to as a "load-side" stationary contact 29*b*. As disclosed in U.S. Pat. No. 4,251,700, more fully cited above, the movable contact assemblies 33*a*–33*c* are in constant engagement with the load-side stationary contacts 29*b* and when the crossbar 27 is moved to its closed position, these contact assemblies 33*a*–33*c* engage the line-side stationary contacts 28*b* to complete an electrical circuit between the line-side and load-side terminals, which are provided by the lugs 30 and fuse clips 31.

As seen in FIG. 2, one of three detachable arc chutes 34*a*–34*c* is removed from its position where it is mounted to the line-side conductor 28 with screws (not shown) that fit through a mounting flange 36 into tapped holes 28*c* in the terminal portion 28*a* of the conductor 28. The arc chute 34*a* includes a hood 37 of insulating material with right and left sections that house a plurality of deionization plates (not shown in FIG. 2). The arc chute 34*a* encloses the area of contact between the movable contact assembly 33*a* and the line-side stationary contact 28*b* to cool and extinguish arcs that can occur during operation of the switch 20.

In contrast to the switch shown in FIG. 2, the switch 10 of FIG. 1 that incorporated the present invention has a line-side conductor 17 and a load-side conductor 18 which are mounted in their own respective modules 11*a* and 12*a* to provide a number of advantages outlined in the Summary of the Invention. The line-side conductor 17 has a terminal portion 17*b*, which has a forward section that is exterior to the module housing 15 with a double lug 19 mounted on it for connection to a wire coming from a power source. When the contact modules 11*a*–11*c* are in use, a pivotable flap 35 of insulating material is moved to its vertical position to cover the wire connections to the lugs 19 from the front. A main terminal bolt 38 is threaded into a tapped hole 17*c* (FIG. 3) in the terminal portion 17*b* of the conductor 17 and extends through a bore in a yoke-shaped lug blade 39 seen best in the detail FIG. 1*a*. A hex nut 40 is threaded onto the end of the bolt 38 that extends through the conductor 17 to bear on the lug blade 39 through a washer 41. The lugs 19 surround the respective legs of the lug blade 39 and are held in place by lug bolts 42 that are threaded therethrough to bear on the legs of the lug blade 39. An antiturn device is formed of an apertured, bent flange 43 (FIG. 1 and 8) that is mounted to the conductor with two blunt-ended screws 44 (FIG. 1*a* and 8), the flange 43 having a large aperture with angular interior edges, which is seen best in FIG. 8 and which prevents the hex head on the main terminal bolt 38 from rotating. As seen in FIG. 1*a* the heads of the screws 44 are positioned on opposite sides of a stop 39*a* formed on the lower end of the lug blades 39 to prevent its rotation around the main terminal bolt 38. It will, of course, be understood by those skilled in the art that other types of line terminal structures may also be mounted on the terminal portion 17*b* of line-side conductor 17.

Figure 6:
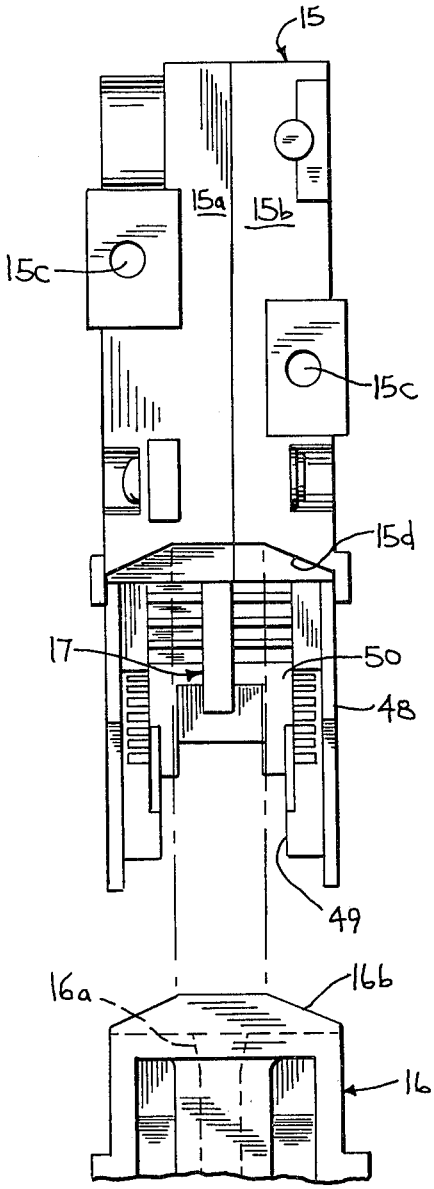
FIG. 6 is a rear view of the line-side contact module and pedestal of FIG. 3.

As seen in FIG. 3, the housing 15 for each of the line-side contact modules 11*a*–11*c* is generally L-shaped. The housing 15 is divided into a right-half section 15*a* and a left-half section 15*b* which are seen open faced in FIG. 7. These counterparts are molded of an electrically insulating thermoset polyester material. Referring to FIGS. 3 and 8, the housing sections 15*a* and 15*b* are riveted together to provide a housing 15 with a vertically extending, insulating base portion 47 that insulates the rearward side portions of the conductor 17 to its back and to its sides from the metal back support 13*a* as seen in FIG. 8. The housing 15 also forms an arc chute hood 48 that extends forward from the lower end of its insulating base portion 47 and which further forms a downwardly opening cavity 49 seen best in FIGS. 4 and 6. The cavity 49 is enclosed on its sides by downwardly extending sides of the arc chute hood 48 that are seen in FIGS. 3 and 6. Referring to FIGS. 3 and 4, there is an insulating region to the rear of these sides where the pedestal 16 of the load-side contact module 12*a* abuts the housing base 47, when the modules 11*a* and 12*a* are assembled in the switch 10. The cavity 49 has a contact region which extends forward from this abutment area and in which an uninsulated portion of the conductor 17 forms a stationary contact 17*a* for the line-side contact module 11*a*. The region of the cavity 49 forward of this contact region 49*a* is an arc chute region 49*b* in which deionization plates 50 are provided to cool and extinguish arcs that can be generated by the opening and closing of the movable contact assemblies and the stationary contact 17*a* formed by the line-side conductor 17.

Figure 5:
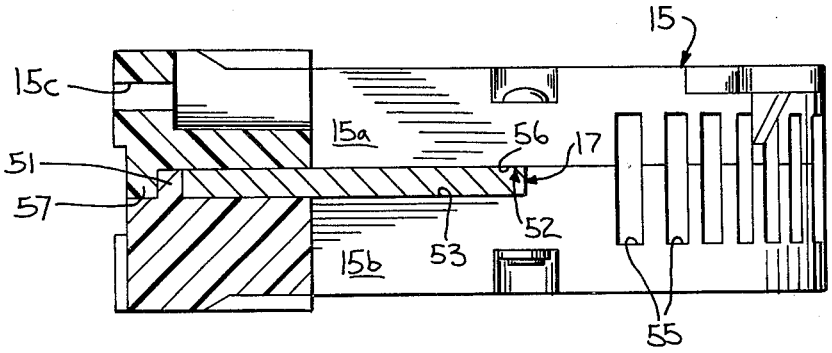
FIG. 5 is a top view of the line-side contact module of FIG. 3 with a portion seen in section.
Figure 7A:
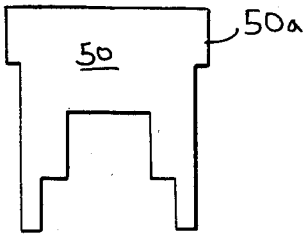
FIG. 7*a* is a detail view of a deionization plate that has been removed from the housing of FIG. 7.
Figure 7:
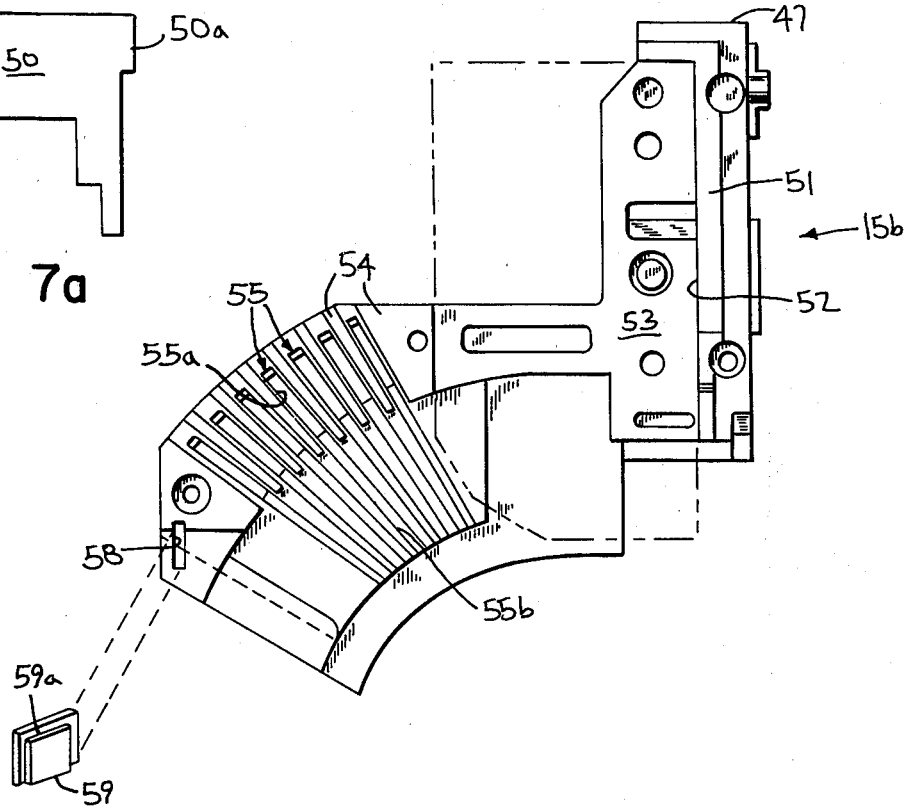
FIG. 7 is an exploded view of the line-side contact module housing of FIG. 3.
Figure 7:
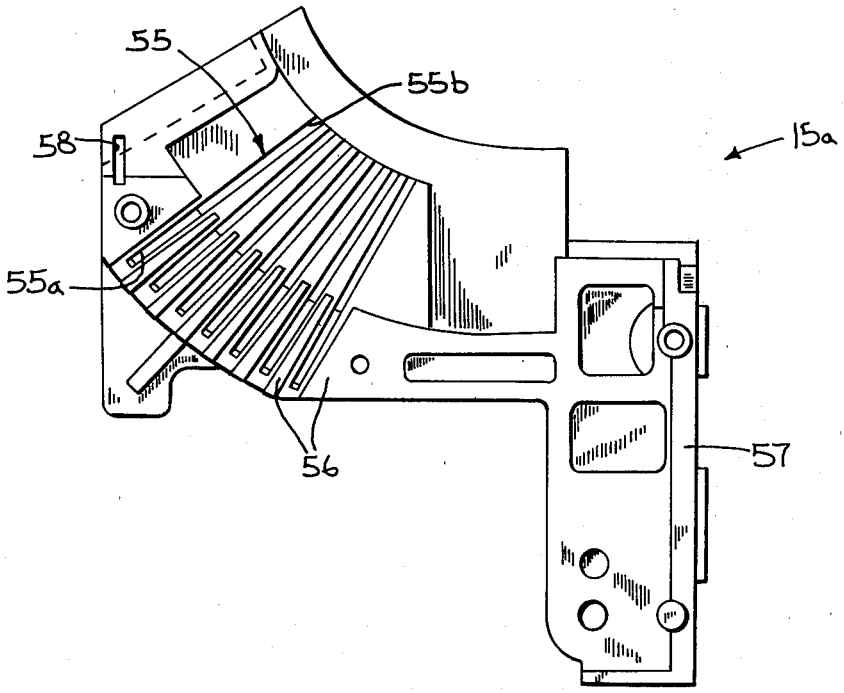
Figure 8:
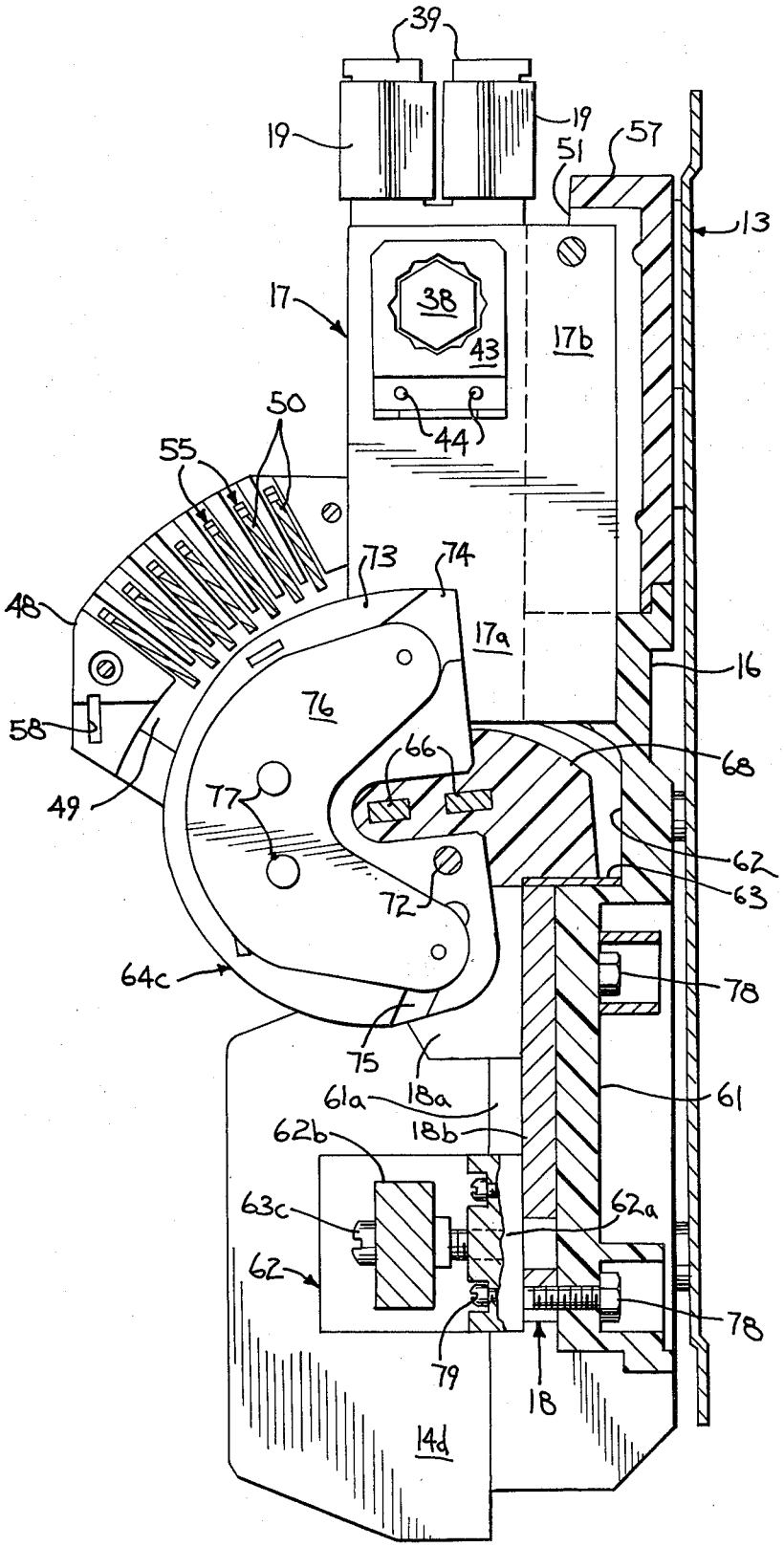
FIG. 8 is a sectional view taken in a vertical plane through the left compartment of the switch of FIG. 1 along line 8—8.

Referring to FIG. 7, the upper or left-half section 15*b* of the housing 15 has an L-shaped ridge 51 of rectangular cross section formed along and spaced a short distance from the top and back sides of the insulating base portion 47. The forwardly facing side of this ridge 51 forms the deepest portion of a slot 52 for receiving the line-side conductor (seen in phantom). The slot is further defined by a surface 53 that extends from this ridge forward to a raised surface 54 in which grooves 55 are formed to receive the deionization plates 50. Referring to the lower part of FIG. 7, and to FIG. 5, the right-half section 15*a* of the housing 15 has a surface area 56 that completes the surface defining the conductor slot 52. As seen in FIGS. 4 and 5, the two housing sections 15*a* and 15*b* are coupled along the plane of this surface area 56. The right housing section 15*a* also has a ridge 57 running along its back edge, and this ridge 57 is received in the space between the ridge 51 of the left housing section 15*b* and its back side as seen in FIGS. 4 and 5. The grooves 55 for the deionization plates 50 are formed along radii which are angularly spaced along the arc of curvature for the arc chute hood 48. The upper portion 55*a* of each of these grooves 55 is cut to a greater depth than the lower portion 55*b* to receive an ear flange 50*a* of one of the deionization plates 50 shown in FIG. 7*a*, so that when the housing sections 15*a* and 15*b* are fastened together, the deionization plates 50 will be mounted within the arc chute region of the housing cavity 49. In their inverted "U" configuration the plates 50 will be disposed astride the arc chute region immediately in front of the stationary contact 17*a* as seen best in FIG. 4 to perform their function in cooling and extinguishing arcs that may occur in that region. The grooves 55 extend through the top of the housing sections 15*a* and 15*b* to provide vents for dissipating heat developed in the deionization plates 50. The housing sections 15*a* and 15*b* also each have a notch 58 at the forward end for receiving projections 59*a* on opposite sides of a lip member 59 that encloses the front of the arc chute hood 48 as seen in FIGS. 1 and 8.

Referring to FIGS. 3 and 4 the line-side conductor 17 has a bar-shaped metal member that is generally rectangular except for a rearwardly and downwardly slanting lower front edge, which is shaped for disposition roughly parallel to the rearmost deionization plate 50. The conductor 17 has the tapped hole 17*c* for receiving the main terminal bolt, two holes 17*d* for receiving the antiturn device screws and two holes (not shown) to receive two hex head bolts 60 that mount the conductor 17 and the housing 15 as seen in FIG. 3. These bolts 60 extend horizontally through recessed apertures in the insulating base portion 47 of the housing 15.

Referring to FIGS. 1 and 8, each load-side contact module 12*a*–12*c* has an insulating base 61 which is molded from an electrically insulating thermoset phenolic material and which is mounted to a lower portion of the back support 13*a*. The base 61 includes a crossbar-receiving cavity 62 similar to the one seen in FIG. 2, except that a bumper pad 63 of resilient material is disposed on an upwardly facing surface in the cavity 62 as seen in FIGS. 3 and 8. Referring to FIGS. 1 and 8 each load-side contact module 12*a*–12*c* has a conductor 18 with a bar-shaped terminal portion 18*b* laying in the bottom channel 61*a* formed angularly in the insulating base 61 relative to the vertical. The terminal portion 18*a* is held in place by bolts 78 extending from the underside of the base 61. Fuse clips 62 are each mounted to a vertical portion 18*a* with screws 78 that extend through holes in a clevis 62*a*. A clamping plate 62*b* is coupled to the clevis 62*b* with an adjustment bolt 62*c* to hold one lead of a fuse (shown in phantom in the middle compartment in FIG. 1). The clip 62 has been removed from the right compartment in FIG. 1 for a better view of the terminal portion 18*a* of the load-side conductor 18. Referring to FIG. 8, a vertically disposed load-side stationary contact 18*a* projects from the upper end of the terminal portion 18*b*. Above the crossbar-receiving cavity 61 as seen best in FIG. 3, each load-side module 12*a*–12*c* forms a pedestal 16 to support its corresponding line-side module 11*a*–11*c* and to receive the lower rear corner section of the conductor 17 in its slot 16*a* to provide a tongue-in-groove coupling between each pair of modules 11*a*–12*a*, 11*b*–12*b* and 11*c*–12*c*. The pedestal 16 also forms a trapezoidal projection 16*b*, seen best in FIG. 6, which is received in a corresponding niche 15*d* in the housing as seen in FIGS. 3 and 8.

To complete contact structure of the switch 10, three movable contact assemblies 64*a*–64*c* are mounted on a crossbar 65. The crossbar 65 includes a metal insert 66 which is bent at each end to form arms that extend inwardly along the sidewalls 13*c* and 13*d* to mount on pivot pins 67 that are aligned along a horizontal pivot axis. A body 68 of electrically insulating, glass-reinforced polyester material is molded around the insert 66 in a complex shape to form support members for the movable contact assemblies 64*a*–64*c* and to form cam actuating members for actuating auxiliary contact assemblies 69, which are of the type disclosed in U.S. Pat. No. 3,949,333, issued Apr. 6, 1976, and assigned to the assignee of the present invention. These contact assemblies 69 are mounted on forwardly projecting cartridge supports 70 that are, in turn, mounted to the back support 13*a*.

Referring to FIG. 8, the movable contact assemblies 64*a*–64*c* have a generally crescent shape and include a deep slot which extends inward from one edge. Each contact support in the molded body 68 of the crossbar 65 forms a boss which snugly receives the slot and firmly supports the movable contact assembly 64*a*–64*c*. The boss and the upstanding walls which surround it restrain all relative motion except in a single substantially vertical plane that is also substantially perpendicular to the back support portion 13*a* of the switch frame 13. The movable contact assemblies 64*a*–64*c* are each locked in place, as seen in cross section in FIG. 8, by a pin 72 which is received in the underside of the contact support and held in place by a hitch pin (not shown).

Still referring to FIG. 8, each movable contact assembly 64*a*–64*c* includes a pair of metallic contact blades 73 which are spaced apart by a pair of metallic spacer elements (not seen). Each blade 73 has an inwardly projecting embossment 74 on its upper cusp that contacts the line-side stationary contact 17*a*, and an inwardly projecting slot-shaped embossment 75 on its lower cusp that contacts the load-side stationary contact 18*a*. Spring blades 76, one of which is seen in FIG. 8, are held against opposite outer surfaces of the respective contact blades 73 and the blades 73 and 76 are fastened together with rivets 77. The assemblies 64*a*–64*c* are thus capable of providing a sliding contact against opposite sides of the stationary contact members 17*a* and 18*a*.

The lower portion of each movable contact assembly 64*a*–64*c*, as seen in FIG. 8, is radially close to the horizontal pivot axis for the crossbar 65 so that such portion is in constant engagement with the load-side stationary contact 18*b*. As the crossbar 65 is pivoted towards the back support 13*a* to a closed position, the upper portions of the contact assemblies 64*a*–64*c* engage the line-side stationary contacts 17*a*, and as the crossbar 65 is pivoted away from the back support 13*a* to an open position, the contact assemblies 64*a*–64*c* slide off the line-side stationary contacts 17*a*. Referring to FIG. 1, colored, visual indicator 71 of insulating material with the word "open" thereon is mounted between the contact blades 73 and disposed for eye contact generally along a horizontal line of sight when the crossbar 65 is in the open position. A similar indicator (not seen in FIG. 1) is located along the lower front edges of the contact blades 73 and has the word "closed" marked thereon, for viewing when the crossbar 65 is moved to its closed position.

The crossbar 65 is driven by a trip mechanism 80, which is mounted on the left side in this embodiment and this trip mechanism is described in U.S. Pat. Nos. 3,959,615 and 4,251,700. The resilient pad 63 seen in FIGS. 3 and 8 cushions impact and inhibits noise when the crossbar 65 is driven to its closed position by operating the trip mechanism 80.

We claim:

1. A disconnect switch of a type having a frame with a back support and with two upright spaced sidewalls extending forward from said back support to define at least one compartment, having a crossbar disposed across said compartment with arms at opposite ends that extend inwardly along respective sidewalls to respective pivotal connections, having a load-side stationary contact and a line-side stationary contact that are vertically spaced apart, and having a movable contact blade carried on said crossbar in continuous sliding contact with said load-side stationary contact and for sliding engagement with said line-side stationary contact as said crossbar is pivoted from an open position to a closed position, wherein the improvement comprises:

a load-side contact module with an insulating base mounted to a lower portion of said back support and with a conductor on said insulating base that forms said load-side stationary contact; and a line-side contact module with a housing of insulating material that is removably mounted from its front side to an upper portion of said back support above the insulating base of said load-side contact module, said housing having an insulating base portion and having an arc chute hood portion projecting forward from said insulating base portion and defining a downwardly opening cavity, said line-side contact module also having a bar-shaped conductor mounted on its insulating base portion in an upright position generally perpendicular to said back support, said bar-shaped conductor extending downwardly into said cavity to provide said load-side stationary contact, and said bar-shaped conductor extending upwardly through said arc chute hood and forward of said insulating base to provice a terminal portion.

2. The disconnect switch of claim 1, wherein said housing for the line-side contact module is comprised of two integrally formed pieces that are coupled together along a plane substantially parallel to said conductor for the line-side contact module, said housing pieces forming a slot along said plane of coupling and said conductor for the line-side contact module being received in said housing slot and being sandwiched between said housing pieces.

3. The disconnect switch of claim 1, wherein said insulating base for the load-side contact module forms a pedestal at its upper end, said pedestal further forming a slot in a substantially vertical plane that receives a downwardly extending portion of said conductor for the line-side contact module, whereby said pedestal formed by the load-side contact module insulates a portion of said conductor that is part of the line-side contact module.

4. The disconnect switch of claim 2 or 3, wherein there are a plurality of laterally spaced line-side contact modules mounted above and in alignment with a corresponding plurality of laterally spaced load-side contact modules, and wherein the crossbar carries a plurality of movable contact assemblies each adapted to engage the stationary contacts in a respective pair of load-side and line-side contact modules, thereby forming a multipole disconnect switch.

* * * * *

UNITED STATES PATENT AND TRADEMARK OFFICE

CERTIFICATE OF CORRECTION

PATENT NO. : 4,395,606

DATED : July 26, 1983

INVENTOR(S) : Albert A. Zaffrann, et al

It is certified that error appears in the above—identified patent and that said Letters Patent is hereby corrected as shown below:

Column 2, line 47, "thereto" should be --therefor--

Column 2, lines 46-47, "in references" should be --and reference is--.

IN THE CLAIMS:

Column 8,line 10, "provice" should be --provide--.

Signed and Sealed this

*Eleventh* Day of *October 1983*

[SEAL]

*Attest:*

GERALD J. MOSSINGHOFF

*Attesting Officer*

*Commissioner of Patents and Trademarks*